United States Patent [19]

Jackson et al.

[11] Patent Number: 5,058,899

[45] Date of Patent: Oct. 22, 1991

[54] PADDLE BALL GAME WITH NET LIKE SHEET WITH COMPLETELY SURROUNDED OPENING

[75] Inventors: Jeffrey D. Jackson; Kenneth J. Avance, both of Long Beach, Calif.

[73] Assignee: Suncepts Inc., Long Beach, Calif.

[21] Appl. No.: 490,749

[22] Filed: Mar. 8, 1990

[51] Int. Cl.[5] ..... A63B 61/00; A63B 63/00

[52] U.S. Cl. ..... 273/411; 273/298; 273/402

[58] Field of Search ..... 273/402, 411

[56] References Cited

U.S. PATENT DOCUMENTS

| | | | |
|---|---|---|---|
| 4,457,513 | 7/1984 | Thompson | 273/411 |
| 4,826,178 | 5/1989 | Cloran | 273/411 |
| 4,834,392 | 5/1989 | Nixon | 273/411 |

*Primary Examiner*—William H. Grieb

[57] ABSTRACT

A game played with a net placed vertically dividing the playing area into at least two sides. The net has a completely surrounded opening, comprising the playing zone, allowing an object and or projectile to be volleyed through the opening in the net, back and forth between the players on opposite sides of the net.

18 Claims, 2 Drawing Sheets

PADDLE BALL GAME WITH NET LIKE SHEET WITH COMPLETELY SURROUNDED OPENING

BACKGROUND OF THE INVENTION

This invention relates to a game, such as a paddle and ball game, where a projectile is hit back and forth between players located any distance apart. Even more so is the improvement made to any like game by placing a net with an inner opening between the opposing players. Thereby, adding dimension, structure, and a means of determining fair play; thereby eliminating a major problem with many present paddle ball games. This invention pertains to a paddle and ball game that can be played universally the same indoors and outdoors and is easily attached to present court game standards (i.e. Volleyball, Walleyball, Racquetball, and etc.).

SUMMARY OF THE INVENTION

This invention provides a game that can be played either as a recreational game or as a professional sport: played either inside, as in a gym or racquetball court, or outside, as on the beach. The game is played preferably by two players, with the object of hitting the ball through the completely surrounded inner opening past your opponent and being the first to reach 21 points.

The preferred method of play is with a ball, paddles, line markers, and a net like sheet. However, one may use body parts (i.e. feet, hands, head, etc.), sticks, rackets, and etc. to hit not just a ball but any object or projectile. The net is supported by poles and anchor ropes at both ends, or is attached to two opposite side walls in a three or four wall court. The net includes a inner opening, which is the playing zone, through which the ball must pass; when going back and forth between the players. The paddles are used to hit the ball. The game is structured to allow its players to play at their own speed, striving for maneuverability and developing their best strategy. It is governed by rules, as set forth below.

DETAILED DESCRIPTION OF PREFERRED EMBODIMENT

An embodiment of the game of the invention is discussed for purposes of illustration and description. This preferred embodiment and rules of play pertain to one example.

Figure 1:
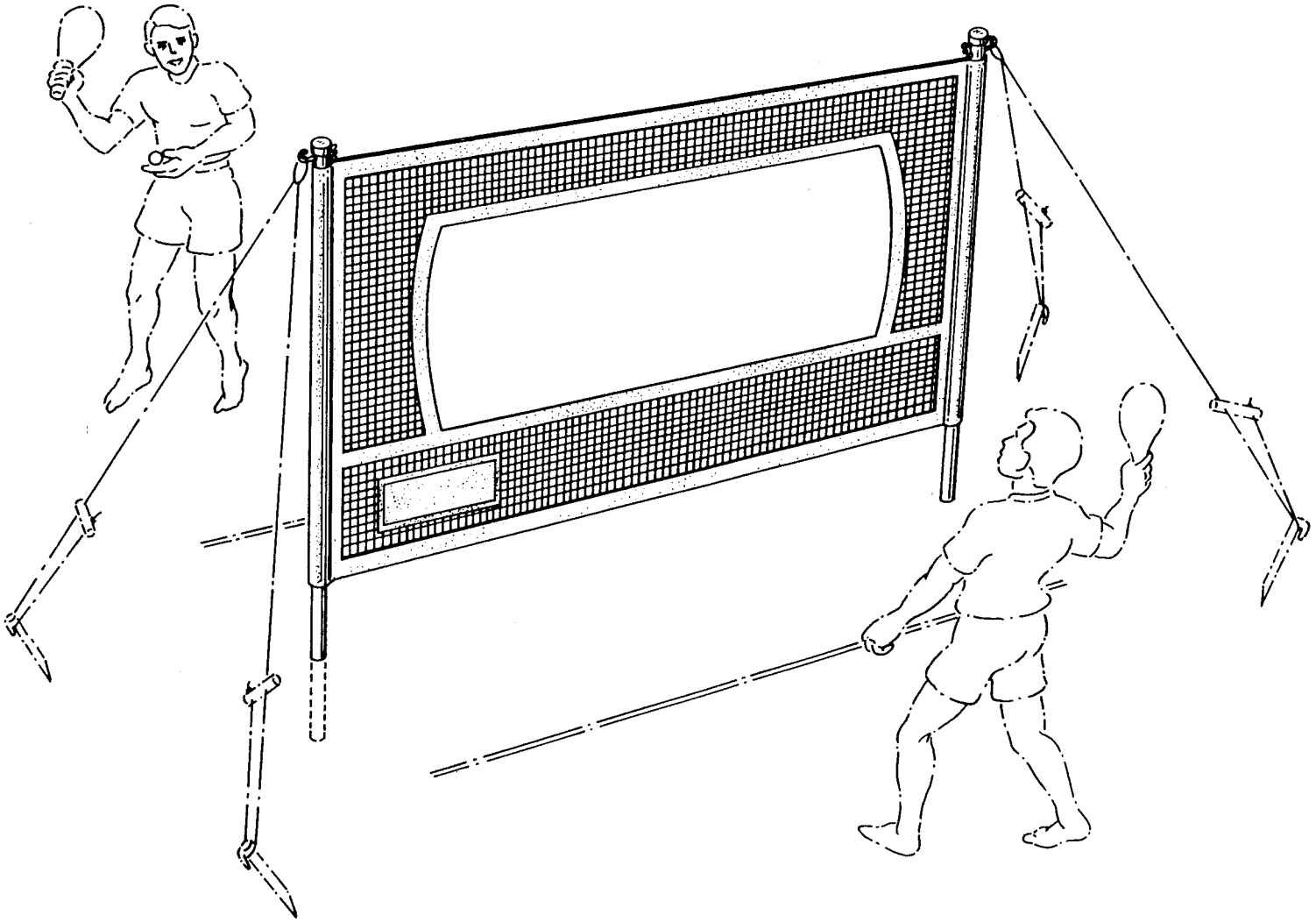
FIG. 1 is an aerial view of the playing area. Showing the various markers; such as the 'Drop Line'—which is the end of the 'Dead Zone', as well as their location within the playing area, the net, poles, and anchor ropes. The hatched area is referred to as the 'Dead Zone,' and the 'Drop Line' is denoted by the number 2.

The net, which is 9 feet 6 inches long and has a vertical dimension of 7 feet, is placed in the center of the playing area, dividing it into two sides. This is done in such a manner that the bottom of the net is elevated 1 foot above the ground, thereby making the distance from the ground to the top of the net 8 feet. The net's inner opening is 6 feet long by 3 feet 6 inches. The 'Drop Line,' 2 in FIG. 1 is placed 8 feet back from the net on both sides, aligned with the length of the net's completely surrounded inner opening (Note: The 'Drop Line,' is a piece of material at least 6 feet long and at least 6 inches wide. The material can be any rubber, plastic, wood or such like substance.)

Figure 2:
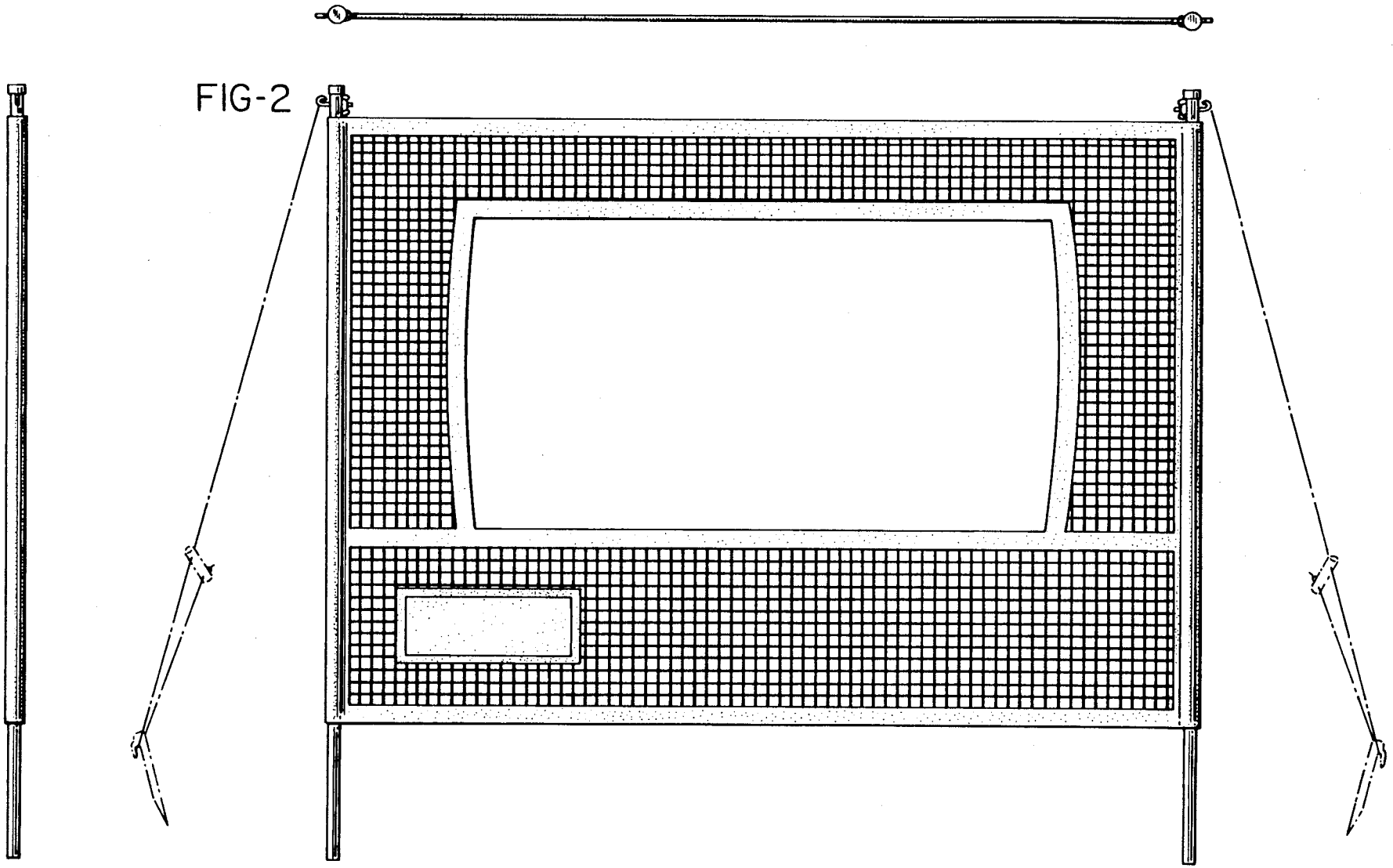
FIG. 2 is a cross sectional view of the net, poles, playing area, markers, and anchor ropes.

The game is played by using the paddles to hit the ball back and forth between players, through the net's inner opening, 1 in FIG. 2. This inner opening is referred to as the 'Playing Zone.' The object is to hit the ball through the 'Playing Zone', past your opponent or to you opponent in a manner in which your opponent is unable to return the ball. A point results in the inability of the non-serving player to return the ball. You must serve to score. However, if the non-serving player forces the serving play to error then a 'Side Out' is called and the serve is switched. The game is played to 21.

Rules of play

The player who is to serve first, must be chosen by some fair form between players (e.g. coin toss, volley, paddle spinning, etc.).

During the course of play, the players must stand behind their respective 'Drop Line' and at no time are allowed to step on the 'Drop Line' or in the 'Dead Zone' (Note: The area from the 'Drop Line' to the net, on both sides of the net, is referred to as the 'Dead Zone' and is considered the non-playing area.).

The ball remains in fair play as long as it is hit by either player through the central opening and remains airborne beyond the 'Drop Lines'.

No player may hit the ball more than one time before it passes through the 'Playing Zone'.

The serve is a two pass volley—meaning the ball must pass through the 'Play Zone' twice before becoming live, making the third hit the first hit that can be an aggressive hit. The serving player is the one to hit the ball first and the first to aggressively attack the ball.

At the serve, both the serving and the receiving player must stand just behind their respective 'Drop Line' and remain there until the ball becomes live.

After the serve, play continues until a point is won, a side out is achieved, or a fault is committed.

A point can only be won by the player who served, when the server is successful in not allowing the receiving player to return the ball back through the 'Playing Zone' passed the serving player's 'Drop Line' at anytime during the volley.

A 'Side Out' is awarded when the receiving player is successful in not allowing the serving player to return the ball through the "Playing Zone" passed the receiving players's 'Drop Line' any time during the volley.

When a 'Side Out' is achieved the receiving player becomes the server.

A Fault is committed when the ball hits the net on the serve, when the serving player steps on or in front of the service line during the serve, when either player steps on the 'Drop Line' or in the 'Dead Zone'. (Remember: the area between the net and the 'Drop Line' is referred to as the 'Dead Zone.')

After a fault is committed, the player who is not at fault serves, and if it was the serving player who was not a fault a point is scored.

The ball is allow to hit the net during the course of play, except during the serve, as long as it travels or lands past the respective 'Drop Line' before it is returned, a point is won, or a side out is called.

The game is played until a player obtains 21 points with a point differential of at least 2 points.

If the differential at 21 is not at least 2 points the game is continued until the necessary differential to win is reached.

What is claimed is:

1. A game comprising:

a sheet of desired height and width, positionable in a substantially flat upright position on a plane surface, with said sheet having a completely surrounded inner opening, which determines and establishes the playing zone by creating and defining the vertical playing zone;

a projectile;

a plurality of paddles for use by players on opposite sides of said sheet as a means of hitting the projectile back and forth through said completely surrounded inner openings; and opposing horizontal markers, which are structures on said playing surface substantially parallel to said sheet disposed at substantially equidistant locations on respective sides of said sheet delineating the playing area from the "Dead Zone", where the playing area is the area in which the players on both sides of said sheet are allowed to stand and play from in order to return the projectile back through the completely surrounded inner opening of said sheet and the "Dead Zone" is the area between the horizontal markers, divided by said sheet, which is considered the non-play region where no player can stand or hit the projectile from nor can the projectile land after being hit;

whereby completely surrounded inner opening is disposed within said sheet so that said sheet and the vertical field said sheet defines, creates the games boundaries preventing the projectile from going back and forth to either side of said sheet unless it is in the field of play, which is determined by said sheet, said completely surrounded inner opening, and opposing horizontal markers.

2. A game as in claim 1, wherein said sheet is a net and acts as the boundary in vertical plane for the game's airborne projectile.

3. A game as in claim 1, wherein the inner opening has a area of no more than 33% of said sheet's total dimensioned area.

4. A game as in claim 3, wherein the net is 9 feet 6 inches long by 7 feet.

5. A game as in claim 4, wherein the completely surrounded inner opening is 6 feet long by 3 feet 6 inches.

6. A game as in claim 1, that can be played universally the same indoors and outdoors.

7. A game as in claim 1, wherein the 'Drop Line, ' a piece of material at least 6 feet long and at least 6 inches wide, is the only ground and horizontal plane boundary.

8. A game as in claim 1, wherein the net gives the game dimension, structure, and a means to determine fair play, by determining the 'Playing Zone, ' the area in which the projectile is volleyed back and forth through.

9. A game as in claim 1, wherein the net gives the game dimension, structure, and a means of determining fair play.

10. A game as in claim 1, wherein the projectile is a ball.

11. A game as in claim 1, wherein the sheet is stretched across the approximate middle of the two playing sides between the ends.

12. A game as in claim 1, further comprising a game area having non playing areas up to 8 feet back from the sheet on both sides of the sheet and a playing area beginning just beyond the non playing areas.

13. A method of play for a game comprising:

providing a sheet of desired height and width, positionable in a substantially flat upright position on a plane surface, with said sheet having a completely surrounded inner opening, which determines and establishes the playing zone by creating and defining the vertical playing field:

providing a projectile;

providing a plurality of paddles for use by players on opposite sides of said sheet; hitting the projectile back and forth through said completely surrounded inner opening; and providing opposing horizontal markers, which are structures on said playing surface substantially parallel to said sheet disposed at substantially equidistant locations on respective sides of said sheet delineating the playing area from the "Dead Zone", where the playing area is the area in which the players on both sides of said sheet are allowed to stand and play from in order to return the projectile back through the completely surrounded inner opening of said sheet and the "Dead Zone" is the area between the opposing horizontal markers, divided by said sheet, which is considered the non-play region where no player can stand or hit the projectile from nor can the projectile land after being hit: Whereby completely surrounded inner opening is disposed within said sheet so that said sheet and the vertical field it defines, creates the games boundaries, preventing the projectile from going back and forth to either side unless it is in the field of play, which is determined by said sheet, said inner opening, and opposing horizontal markers.

14. A method of play as in claim 13, wherein said sheet is a net 9 feet 6 inches long by 7 feet stretched across the approximate middle of the playing area creating two playing sides, with said sheet's completely surrounded inner opening being 6 feet long by 3 feet 6 inches, a ball as the projectile and 2 opposing horizontal markers markers called "Drop Lines" placed at least 8 feet back from said net on the playing surface for both playing sides.

15. A method of play as in claim 14, wherein there are at least two players who are positioned on opposite sides of the net, behind the "Drop Line" on their respective side, each having a paddle and at least one equipped with at least one ball.

16. A method of play as in claim 15, wherein the game begins when the serving player hits the ball with said paddle through said completely surrounded inner opening passed the non-serving player's "Drop Line" and continuing the game by opposing players returning said ball back and forth through said completely surrounded inner opening of beyond the respective opposing "Drop Line".

17. A method of play as in claim 16, wherein the players, after the serve, hit the ball with said paddles through completely surrounded inner opening of said net, passed the "Drop Line" on the opposing sides in a manner that will hopefully prevent the opposing player from returning said ball back through said completely surrounded inner opening beyond the respective opposing "Drop Line".

18. A method of play as in claim 17, wherein a point is scored when the "Server" or the serving side causes the opposing player or players to fail in an attempt to return said ball through the completely surrounded inner opening of said net beyond the server's "Drop Line" and no point is scored when the non serving side causes the serving side to fail in an attempt to return said ball back through said completely surrounded inner opening of said net beyond the non-serving side's "Drop Line".

* * * * *